United States Patent [19]

Torii

[11] Patent Number: 4,522,392

[45] Date of Patent: Jun. 11, 1985

[54] SPRING TYPE LEG EXERCISING DEVICE

[75] Inventor: Masakatsu Torii, Saitama, Japan

[73] Assignee: Saitama Kako Co., Ltd., Japan

[21] Appl. No.: 408,154

[22] Filed: Aug. 16, 1982

[51] Int. Cl.[3] ..... A63B 21/02

[52] U.S. Cl. ..... 272/142; 272/134

[58] Field of Search ..... 272/138, 139, 135, 142, 272/136, 70, 137, 144, 93, 900

[56] References Cited

U.S. PATENT DOCUMENTS

| | | | |
|---|---|---|---|
| 1,486,732 | 3/1924 | Cooper | 272/138 |
| 1,982,843 | 12/1934 | Traver | 272/70 |
| 2,720,396 | 10/1955 | Pfaus | 272/142 |
| 2,760,774 | 8/1956 | Perez | 272/142 |
| 3,559,986 | 2/1971 | Ehrmantraut | 272/70 X |
| 3,584,871 | 6/1971 | Kelmon | 272/138 |
| 3,620,530 | 11/1971 | Cosby | 272/142 |
| 3,664,667 | 5/1972 | McCarthy | 272/142 X |
| 4,111,417 | 9/1978 | Gardner | 272/141 X |
| 4,364,559 | 12/1982 | Valetine | 272/900 |

*Primary Examiner*—Richard J. Apley
*Assistant Examiner*—William R. Browne
*Attorney, Agent, or Firm*—Fisher, Crampton, Groh & McGuire

[57] ABSTRACT

A physical exercise device is disclosed comprising a central connecting means, a pair of base frames having the same construction and symmetrically connected to opposite sides of the central connecting means, a pair of foot boards symmetrically mounted on the top of the respective base frames such that they can be moved away and toward each other, and a spring means connected between each base frame and the associated foot board to bias the foot boards toward each other. An operator may exercise his legs by placing his feet on the foot boards to strengthen the muscles of the abdomen and waist as well as the muscles of the legs in order to enhance, promote and maintain general health.

8 Claims, 13 Drawing Figures

SPRING TYPE LEG EXERCISING DEVICE

This invention relates to a physical exercise device, which can be used mainly for making a physical exercise of opening and closing the legs, and more particularly, to a physical exercise device, which can be used by placing the feet on a pair of spring biased, slidable foot boards for very appropriately making physical exercises for improving the functions of joints and muscles of the legs and also physical exercises for the muscles of the abdomen and waist.

The motion of opening the legs while holding the standing posture is referred to as abduction motion of the hip joints and thighs. The motion of closing the opened legs is referred to as restoring motion. The action of bringing forth a leg is referred to as bending the hip joints and knee joints. When a kick-back action is made with a straight leg, the hip joints and knee joints are said to be stretched. When the kicking leg is further forced back, the hip joints are said to be over-stretched. Self-making these motions by holding the standing posture and thus loading the weight of the upper half of the body on the leg or legs, has the effect of reinforcing the muscles of the legs and abdomen and also increasing the range of motion of the joints, so that the ability of making various motions can be improved.

Further, repeating the motion of opening and closing the legs forces of the muscles of the abducens such as hip muscles, thigh muscles and adduktor muscles of the inner thighs as well as the abdomen, hip and waist muscles to be enhanced, which is desired very much from the standpoint health.

Hitherto, no physical exercise device, which can aid in performing the physical exercises as mentioned above, has been proposed. Calisthenic devices that are available are not helpful to the end mentioned above.

An object of the invention is to provide a physical exercise device, which permits a man who has no outdoor place and little spare time for making physical exercise to readily and satisfactorily reinforce the muscles of the legs, abdomen and waist even in a narrow room and in a short period of time.

Another object of the invention is to provide a physical exercise device, which comprises a pair of base frames provided with foot boards which can be very easily assembled together into various working states for use and disassembled and accommodated.

A further object of the invention is to provide a physical exercise device, which can help make a physical exercise of opening and closing the legs for increasing the angle ranges of the abduction motion and also increasing the thigh's abduction and adducution muscles and thereby promoting and maintaining health.

A still further object of the invention is to provide a physical exercise device, which can be used even by a man who has a trouble in the legs or a man who has become weak due to a disease to make a physical exercise of stretching the hip joints and knee joints in the standing posture so that the functions of the joints and muscles of the legs and the ability of walk can be recovered.

When the physical exercise device according to the invention is used for the physical exercises as mentioned above, not only the afore-mentioned goals of exercises can be attained but also the muscles of the abdomen and waist as well as all the joints and muscles of the legs can be enhanced. Thus, rejuvenation can be realized, and the health of the lower half of the adult's body can be promoted and maintained for a long time.

The above and further objects and features of the invention will become more apparent from the following description when the same is read with reference to the accompanying drawings, in which.

Figure 1:
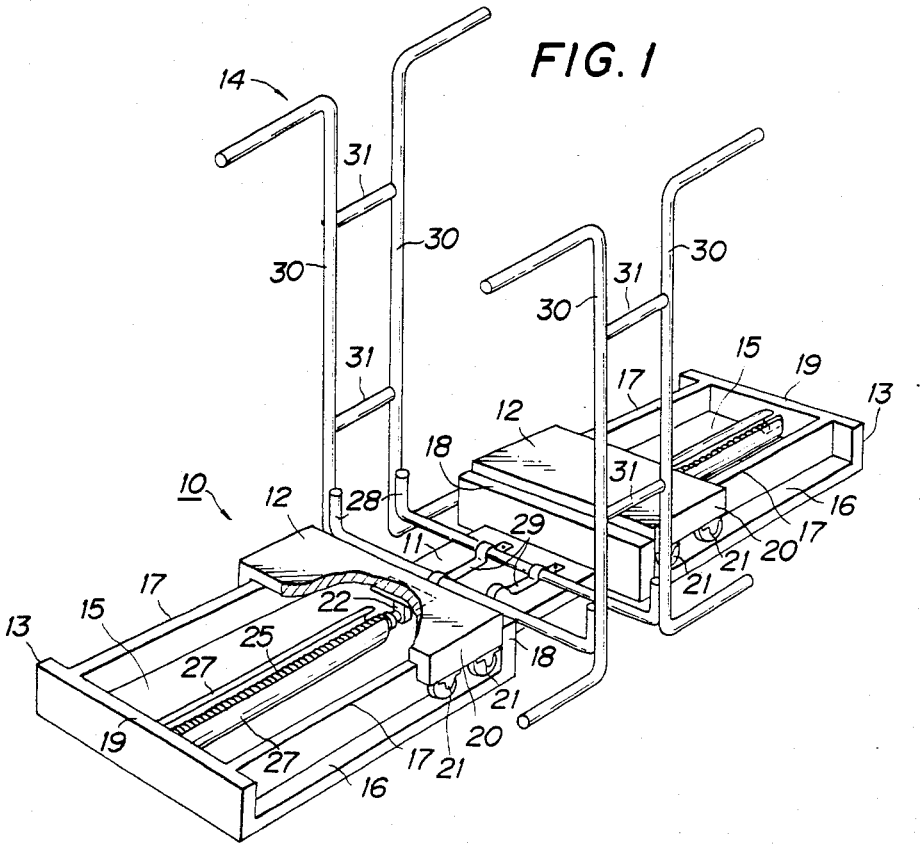
FIG. 1 is a perspective view, partly broken away, showing a first embodiment of the physical exercise device according to the invention.
Figure 2:
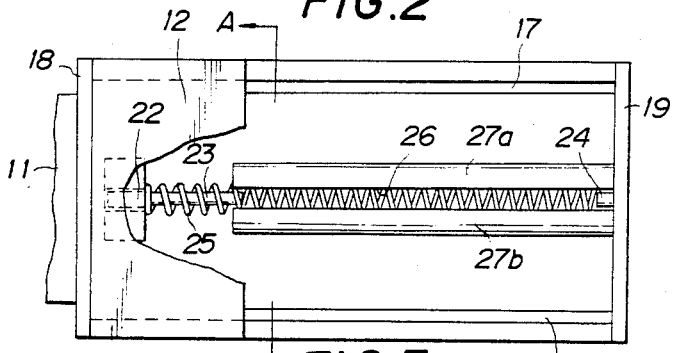
FIG. 2 is an enlarged-scale plan view, partly broken away, showing a portion of the embodiment of FIG. 1.
Figure 3:
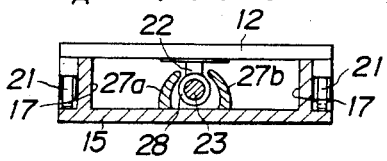
FIG. 3 is a sectional view taken along line A—A in FIG. 2.

FIGS. 1 to 3 show a first embodiment of the physical exercise device according to the invention. The device is generally designated at 10 in FIG. 1. The device 10 comprises a pair of base frames 13 having the same construction and a central connecting member 11, to which the base frames 13 are coupled symmetrically. A pair foot boards 12 having the same construction are mounted symmetrically on the respective base frames 13. A protective frame 14 which can hold the user in an erect posture, is provided on top of the connecting member 11. The protective frame 14 may be omitted.

Each of the base frames 13 includes a bottom plate 12, a pair of longitudinal elongate guides 17 extending upright from the bottom plate 12 and spaced apart from the opposite side edges of the bottom plate 12 to define guide surfaces 16, and inner and outer end walls 18 and 19 extending upright from the inner and outer ends of the bottom plate 15 and integral with the longitudinal elongate guides 12.

Each of the boards 12, which is slidably mounted on top of each base frame 13, has a rectangular top surface having a sufficient area to support the user's foot. The foot board 12 has opposite side slide walls 20 depending from the opposite side edges and are slidable along the outer surface of the guides 17. The slide walls 20 are each provided at the lower end with a pair of rollers 21. These rollers 21 can rotate over the guide surfaces 16 mentioned above of the bottom plate 15 as the foot board 12 is moved inwards and outwards.

A mounting member 22 is secured to the innerside of the foot board 12. A spring retainer pin 23 is secured to the mounting member 22. Another spring retainer pin 24 is secured to the inner wall surface of the outer end wall 19. A compression coil spring 25 has opposite end portions fitted on the spring retaining pins 23 and 24. A pair of cover members 27*a* and 27*b* are mounted on top of the bottom plate 15 such as to cover the opposite sides of the coil spring 25 and define a slit 26. The cover members 27*a* and 27*b*, as shown in FIG. 2, extend from the outer end wall 29 at one end and at the other end substantially corresponding in position to the outer end of the foot board 12 in the innermost set position thereof. The free end of the spring retaining pin 23 substantially corresponds in position to the outer end of the foot board 12. The coil spring 25 thus can be guided by the cover members 27*a* and 27*b* and the coil retaining pin 23 as it compressed and expanded.

The protective frame 14, which may be provided on the connecting member 11, include a pair of channel-shaped members 28 secured by securing members 29 to the connecting member 11 and two pairs of channel-shaped members 30 with the upright portions of the channel-shaped members 30 in each pair being firmly connected to one another by connecting members 31 and secured to each of the opposite end upright portions of the channel-shaped members 28.

Figure 12:
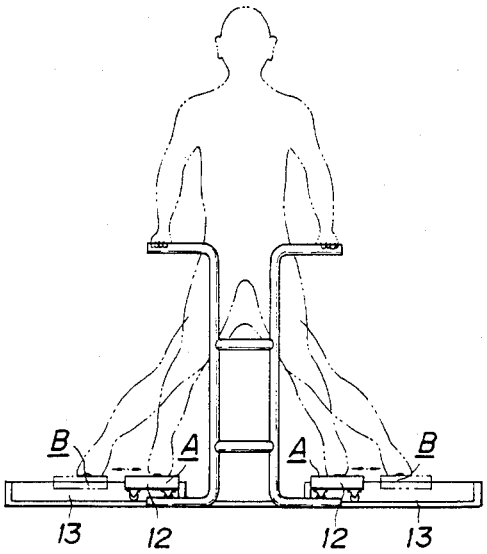
FIG. 12 is a front view showing the physical exercise device of FIG. 1 in use.

The physical exercise device described above is used in the manner as shown in FIG. 12. In the initial position, as shown at A, the user stands with the feet placed on the foot boards 12 and the legs slightly opened. The foot boards 12 are urged toward each other by the springs 25 so that the user can assume this posture without using the muscles of the legs. As the user opens the legs toward the position shown at B, the mounting members 22 which are integral with the foot boards 12 are moved outwards along the respective slits 26. The forces provided by the springs 25 are weaker than the forces exerted to the foot boards 12 in opening the legs in addition to the user's weight, so that that abduction and adducution muscles of the legs shrink. As the distance between the opposite foot is increased, the urging forces of the springs 25 are increased. This has an effect of enhancing the retaining function of the adducution muscles. In closing the legs from the position B, the adducution muscles sufficiently function to have an effect of pulling the foot boards 12 inwards toward the position A. Exercising the action of closing the legs slowly in an initial stage and by progressively increasing the speed of motion has an effect of extremely enhancing the development of the muscles. Particularly, for the enhancement of the adducution muscles a powerful motion of closing the legs can be obtained by virtue of the compression spring 25 interposed between the inner end wall 18 of each base frame 13 and each foot board 12. The motion of opening and closing the legs in the manner as described above has an effect of promoting the enhancement of not only the abduction and adducution muscles but also the muscles of the abdomen, hips and waist. The motion is thus effective for preventing the corpulence of the abdomen and the weakening of the legs and waist, these being an initially symptomatic of adult's diseases.

The protective frame 14 serves not only to permit the user to make a physical exercise with the body supported by gripping the grip portions with the hands but also to prevent forward bending of the user's body from the standing state. If the user's body is forwardly bent at the hip joints, the muscles of the thighs become loose. In this case, the effect of enhancing the muscles cannot be obtained.

FIGS. 4 to 11 show a second embodiment of the physical exercise device according to the invention. This embodiment of device again comprises a pair of base frames 42, which have the same construction. In the state shown in FIG. 4, these base frames 42 symmetrically coupled together via respective connecting members 40 in the form of a straight line so that pair foot boards 41 which have the same construction and are mounted on the respective base frames 42 symmetrically face each other. In this embodiment, the connecting members 40 and base frames 42 are moldings of a synthetic resin, but they may be made of a light metal as well.

Figure 8:
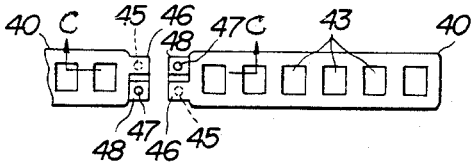
FIG. 8 is a plan view, partly broken away, showing the pair of connecting members with their connecting ends facing each other.
Figure 9:
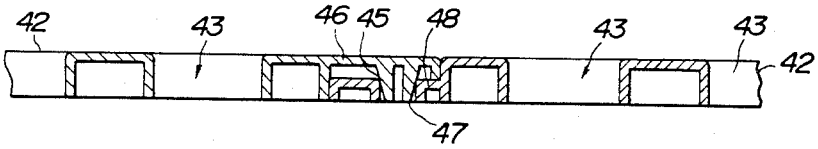
FIG. 9 is an enlarged-scale sectional view taken along line C—C in FIG. 8.

The connecting members 40 have the same construction and are symmetrically connected together as shown in FIG. 1. As shown in FIG. 8, each of them is an elongate member having a rectangular sectional profile and formed with a row of rectangular openings uniformly spaced apart in the longitudinal direction. The connecting members 40 each have a pair of parallel connecting projections 46 and 48 longitudinally projecting side by side from one end. The connecting projections are step-like in configuration such that the upper step is flange fit over the lower flange on the other projection to mate with the protuberances thereon to hold the exerciser together. In the connecting member 40 which is entirely shown in FIG. 8, the connecting projection 46 has a protuberance 45 projecting from its lower surface, while the other connecting projection 48 which extends at a lower level than the connecting projection 46 has an opening. The pair connecting members 40 are connected together with the protuberance 45 of each engaged in the hole 47 of the other, as most clearly shown in FIG. 9.

Each of the base frame 42 includes an upper plate 52 having recesses 49 and 50, which are arranged in a cross-shaped fashion and each of which can receive the associated connecting member 40. A bottom plate 51 is secured by a plurality of screws 53 to the upper plate 52. The upper plate 52 has a plurality of longitudinal integral ribs 54 depending from its lower surface and also from its opposite side edges. The bottom plate 51 abuts against these longitudinal ribs 54 when assembled. The upper plate 52 also has integral longitudinal reinforcing ribs having threaded holes 56, into which the screws 52 are screwed to secure the bottom plate 51. The upper plate 52 is also formed in its reduced level portions adjacent to the opposite side edges with upper longitudinal grooves 57. The upper plate 52 further is formed with a central longitudinal guide slit 58 extending over its entire length. In the recesses 49 and 50 of the upper plate 52, projections 59, 60, 61 and 62 are formed adjacent to the central portions of the four sides. Any one of the openings 43 in the connecting member 40 may be fitted on any one of the projections 59, 60, 61 and 62. Thus the pair base frames 42 may be coupled together in a desired orientation with respect to each other and at a desired spacing between them.

Each of the foot boards 41, which is slidably mounted on top of each base frame, has integral opposite side edge walls 63 and also integral roller mounting walls 64 extending parallel with the respective edge walls 63. A pair of rollers 65 are rotatably mounted in each roller mounting wall 64 and each edge wall 63. These rollers 65 can be guided along the grooves 57 of the upper plate 52. The foot board 41 has an integral central spring mounting member 66 projecting from the lower surface adjacent to the outer end. A tension coil spring 67 is connected at one end to the spring mounting member 66 and connected at the other end to a spring connecting loop 68 integral with one end wall of the frame base 42. The foot board 41 also is provided with an integral retaining member 69 extending from the lower surface adjacent to the inner end. The retaining member 69 penetrates the slit 58 and is provided at the lower end with a portion crossing the slit 58 so that the foot board 41 will not be detached from the base frame 42. Rubber buffers 71 and 72 are provided in the slit 58 at the opposite ends thereof. The foot board 41 can be moved in either direction until the spring retaining member 66 strokes the corresponding one of the rubber buffers 70 and 71.

The physical exercise device having the construction described above are used in the following manner.

Figure 4:
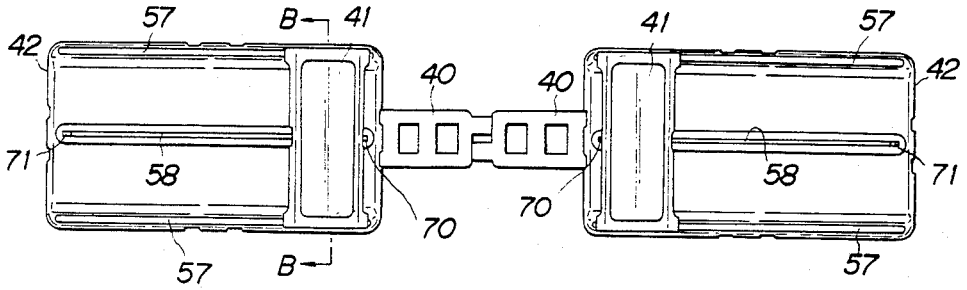
FIG. 4 is a plan view showing a second embodiment of the invention, in a state of use with a pair of base frames symmetrically coupled together by connecting means constituted by a pair of symmetrically coupled connecting members.
Figure 5:
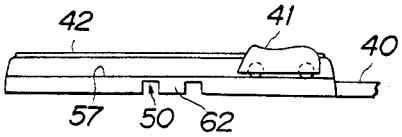
FIG. 5 is a front view showing a base frame.
Figure 6:
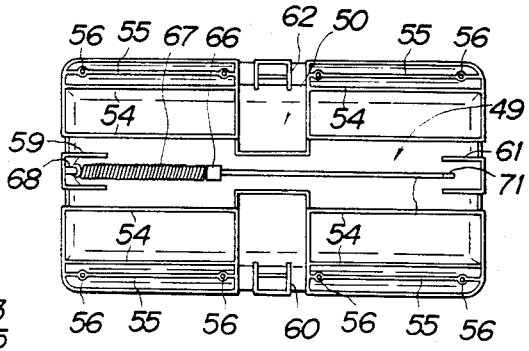
FIG. 6 is an enlarged-scale bottom view showing the internal construction of the base frame with a bottom plate removed.
Figure 7:
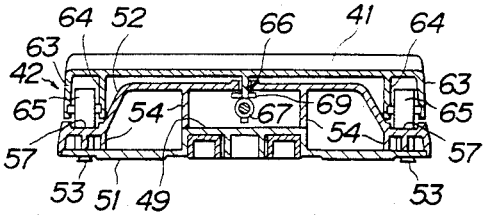
FIG. 7 is an enlarged-scale sectional view taken along line B—B in FIG. 4.

For using the device in one way, it is assembled into the form as shown in FIG. 4. In this case, each connecting member 40 is assembled in each base frame 42 as shown by solid lines in FIG. 11. The arrangement of FIG. 4 is the same as that of the previous embodiment of FIG. 1. Thus, in this case an exercise of opening and closing the legs in the same manner as described earlier in connection with FIG. 2 can be made. With the device of this embodiment, the connecting member 40 can be coupled to the base frame 42 with a desired opening 43 of the connecting member 40 fitted on the projection 59 of the base frame, so that the pair base frames 42 can be spaced apart a desired distance to suit the user's height and leg muscles.

If the protective frame 14 is not used, the standing posture may be held in the exercise by applying both hands to a suitable wall.

Figure 11:
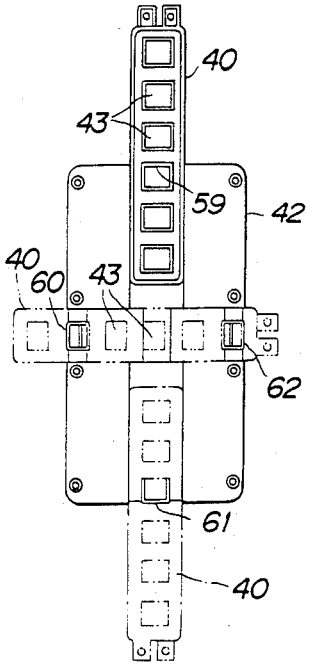
FIG. 11 is a bottom view showing three different ways of assembling the connecting means on the base frames.

If the device is assembled with each connecting member 40 assembled in each base frame 42 as shown by dot-and-bar lines in FIG. 11, the pair foot boards 41 are urged away from each other. When the device is used in this form, a powerful motion of closing legs can be obtained. This exercise has an effect of quickly enhancing the thigh's adducution muscles and abdomen muscles.

Figure 10:
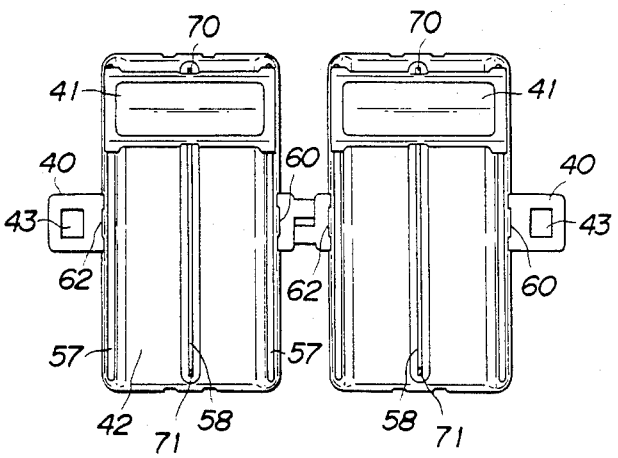
FIG. 10 is a plan view showing the second embodiment in a state of use with the pair base frames assembled side by side and in the same orientation.
Figure 13:
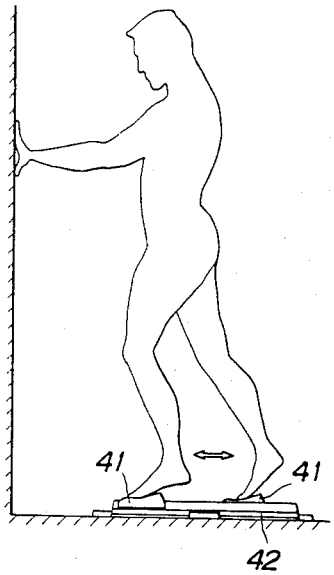
FIG. 13 is a side view showing the physical exercise device of FIG. 4 in use in the state shown in FIG. 10.

The device may further be assembled in a form as shown in FIG. 10, with the pair base frames 42 arranged side by side and oriented in the same way. In this case, each connecting member 40 assembled in each base frame 42 as shown by double-dot-and-bar lines in FIG. 11. The device may be used in this arrangement for an exercise as shown in FIG. 13. As shown in the Figure, by making loose the muscles of the right side leg, this leg is moved forwards by the force of the spring 67 on this side. At the same time, the hip joints and knee joints are bent. By kicking back with the expansion muscles of a leg held taut, this leg is stretched. This motion exercise is useful for standing-up and walking training in the rehabilitation of a physically weak person who has been in bed for long time or a person who has a trouble in the legs. This exercise is also very effective not only for enhancing the function of the legs but also for enhancing the muscles of the abdomen, hips and waist.

I claim:

1. A physical exercise device comprising central connecting means for connecting a pair of base frame members together, said pair of base frame members having the same construction and symmetrically connected to the opposite sides of said central connecting means, a pair of foot boards symmetrically mounted on top of said respective base frames said connecting means connecting the frames so that said foot boards may be reciprocated in paths that are parallel to each other or in line with each other; and spring means connected between each associated base frame and the associated foot board, and each said spring means biasing each associated foot board in a direction opposite to the direction in which a user's efforts has forced the foot board being acted upon.

2. The physical exercise device according to claim 1, wherein said foot boards each are slidably mounted on the associated base frame rollers are mounted on the underside of each foot board that each foot board may move relative to the base frames along guides provided on the base frames.

3. The physical exercise device according to claim 1, wherein said spring means each is a tension coil spring.

4. The physical exercise device comprising connecting means for connecting a pair of base frame members together, sad pair of base frames having the same construction and being connected by the connecting means, a pair of foot boards each slidably mounted on each said base frame member, the foot boards being movable in opposite directions on their respective frame members, said foot boards spring means biasing said foot boards in opposite directions said connecting means comprising a pair of substantially rigid elongated connecting members, each said elongated member being formed with a row of openings uniformly spaced apart along the length of each said connecting member, said base frames each including an upper plate provided with a groove-like recess extending in the directions of movement of the associated foot board, for receiving the associated connecting member, each said foot board being provided with a projection located in said groove-like recess, and each said frame member having a projection means for being fitted in a desired one of said openings in the associated connecting member.

5. The physical exercise device according to claim 4, wherein said connecting members each have a pair of parallel connecting projections longitudinally projecting in the line of motion of the foot boards said projections having a step-like configuration and each said step in the connecting member extending longitudinally at different levels, one of said connecting projections being provided on the side of the level of the other connecting projection with a protuberance, and the other one of said connecting projections being formed with an opening, said connecting members being connected in a fashion of a straight line with said protuberances received in said corresponding openings.

6. The physical excercise device according to claim 4, wherein said upper plate of each base frame is provided with a guide slit extending in the direction of movement of the associated foot board, each said foot board including a spring mounting member projecting from the underside and penetrating said slit and a tension coil spring is connected at one end to the lower end of said spring mounting member and connected at the other end to an end wall of the base frame.

7. The physical exercise device of claim 4, wherein each said foot board includes a pair of rollers provided on each side edge, said pairs of rollers being guided along paired grooves provided on said upper portion of the associated base frame, whereby the rollers ride in the groove in the base frame to minimize wear and friction caused by the movement of the foot boards over the base frame.

8. The physical exercise device according to claim 4, wherein said upper plate of each base frame is further provided with another groove-like recess extending in a direction at right angles to the directions of movement of the associated foot board, for receiving the associated connecting member, and also with another projection located in said another groove-like recess, for being fitted in a desired one of said openings in the associated connecting member.

* * * * *